US007207447B2

(12) United States Patent
Medcalf et al.

(10) Patent No.: US 7,207,447 B2
(45) Date of Patent: Apr. 24, 2007

(54) MODULAR STORAGE AND DISPENSING ASSEMBLY

(75) Inventors: Merle D. Medcalf, Harrah, OK (US); Michael D. Medcalf, Harrah, OK (US)

(73) Assignee: Excell Products, Choctaw, OK (US)

( * ) Notice: Subject to any disclaimer, the term of this patent is extended or adjusted under 35 U.S.C. 154(b) by 175 days.

(21) Appl. No.: 11/010,888

(22) Filed: Dec. 13, 2004

(65) Prior Publication Data

US 2005/0127015 A1 Jun. 16, 2005

Related U.S. Application Data

(60) Provisional application No. 60/528,615, filed on Dec. 11, 2003.

(51) Int. Cl.
*A47F 1/04* (2006.01)

(52) U.S. Cl. ..... 211/59.2; 211/74

(58) Field of Classification Search ..... 211/59.2, 211/74; 312/60, 72, 61, 45
See application file for complete search history.

(56) References Cited

U.S. PATENT DOCUMENTS 2,888,145 A * 5/1959 Knott et al. ..... 211/59.2
3,306,688 A * 2/1967 Di Domenico ..... 312/42
3,784,022 A * 1/1974 Beesley, Jr. ..... 211/59.2
4,356,923 A * 11/1982 Young et al. ..... 211/59.2
4,474,297 A * 10/1984 Zucker ..... 211/59.2
4,685,590 A * 8/1987 Negishi et al. ..... 221/241
4,744,489 A * 5/1988 Binder et al. ..... 221/6
4,911,309 A * 3/1990 Stefan ..... 211/59.2
6,991,116 B2 * 1/2006 Johnson et al. ..... 211/59.2
2002/0043509 A1 * 4/2002 Lajeunesse et al. ..... 211/59.2

* cited by examiner

*Primary Examiner*—Jennifer E. Novosad
(74) *Attorney, Agent, or Firm*—Dunlap, Codding & Rogers, P.C.

(57) ABSTRACT

A modular storage and dispensing assembly for storing and selectively dispensing objects, such as cans, includes a plurality of panels and a connector assembly for connecting adjacently disposed panels such that a chute is formed between each of the adjacently disposed panels. A rail assembly is provided in each chute for defining a travel path through the chute. The rail assembly includes an upper rail and a lower rail, each being supported by adjacently disposed panels such that the upper rails in the chute are spatially disposed and in a facing relationship and the lower rails in the chute are also spatially disposed and in a facing relationship. The upper rails each have a first end and a second end and are sloped in a downward direction from their first end to their respective second ends. The lower rails each have an arcuate shaped second end, the lower rails and their arcuate second ends being disposed a distance from the upper rails such that objects moving along the travel path of the chute are provided with a smooth transition from the upper rails to the lower rails. The modular storage and dispensing assembly also is provided with a stop assembly for restraining an object therein while permitting the object to be removed therefrom.

6 Claims, 4 Drawing Sheets

MODULAR STORAGE AND DISPENSING ASSEMBLY

CROSS REFERENCE TO RELATED APPLICATIONS

This application claims benefit of U.S. Provisional Application 60/528,615, filed Dec. 11, 2003, which is incorporated herein by by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates generally to a storage and dispensing assembly, and more particularly, but not by way of limitation, to a modular storage and dispensing assembly for cans.

2. Brief Description of Related Art

Display racks or assemblies for supporting and displaying articles on shelves or in confined areas, such as a refrigerator or a cold storage unit, are well known. Generally, such display racks or assemblies are gravity fed or utilize a spring mechanism to move articles along one or more travel paths of the display racks or assemblies.

Because there is often wasted space on at least one side of the display rack or assembly, modular display racks or assemblies have been proposed wherein a plurality of the display racks or assemblies are secured together by clips, bolts and the like. Such separate elements, however, often become lost during shipment, and fail to provide the desired rigidity to the assembled modules. Modules of display racks or assemblies have also been provided where individual display racks or assemblies have been combined using dovetail key/keyhole connectors, and the like. However, the use of such connectors have created problems in the manufacture of such display racks or assemblies, have resulted in weak or loose connections, or have made such display racks or assemblies difficult to assemble.

In addition, problems have been encountered in floors or tracks of many of the prior art display racks or assemblies in that the floor or tracks become sticky or clammy due to condensation, garbage, spillage and the like dropping on the floors or tracks. Thus, movement of articles through the display racks or assemblies are impeded, especially in gravity fed display racks or assemblies. As a result, it is often necessary to remove the articles from the display racks or assemblies to either clean or replace the floors or tracks of the display racks or assemblies.

Accordingly, a need remains for modular display racks or assemblies which enable one to readily expand the modular display racks or assemblies, which do not require a large amount of components and which do not create problems with manufacture or construction of such display racks or assemblies. It is to such a modular display rack or assembly that the present invention is directed.

SUMMARY OF THE INVENTION

Broadly, the present invention relates to a modular storage and dispensing assembly for storing and selectively dispensing objects, such as cans. The modular storage and dispensing assembly includes a plurality of panels and a connector assembly for connecting adjacently disposed panels such that a chute is formed between each of the adjacently disposed panels. A rail assembly is provided in each chute for defining a travel path through the chute. The rail assembly includes an upper rail and a lower rail, each being supported by adjacently disposed panels such that the upper rails in the chute are spatially disposed and in a facing relationship and the lower rails in the chute are also spatially disposed and in a facing relationship. The upper rails each have a first end and a second end and are sloped in a downward direction from their first end to their respective second ends. The lower rails each have an arcuate shaped second end, the lower rails and their arcuate second ends being disposed a distance from the upper rails such that objects moving along the travel path of the chute are provided with a smooth transition from the upper rails to the lower rails.

The modular storage and dispensing assembly also is provided with a stop assembly supported by the first end of the lower rails for restraining an object therein while permitting the object to be removed therefrom whereupon the remaining objects are permitted to move along the travel path of the chute and the object adjacent to the one removed is moved to the stop assembly whereby further movement of the objects along the travel path of the chute is prevented until another object is removed from the stop assembly.

An object of the present invention is to provide an improved storage and display assembly for objects, such as cans.

Another object of the present invention is to provide a modular storage and dispensing assembly wherein a number of chutes can be provided in such assembly.

Another object of the present invention is to provide an improved modular storage and dispensing assembly which is economical to manufacture, easy to construct, and which permits one to readily increase or decrease the overall size of the modular storage and dispensing assembly without detracting from its intended use.

Other objects and advantages of the present invention would be apparent to those skilled in the art from a reading of the following detailed description and the appended claims.

DETAILED DESCRIPTION OF THE INVENTION

Figure 1:
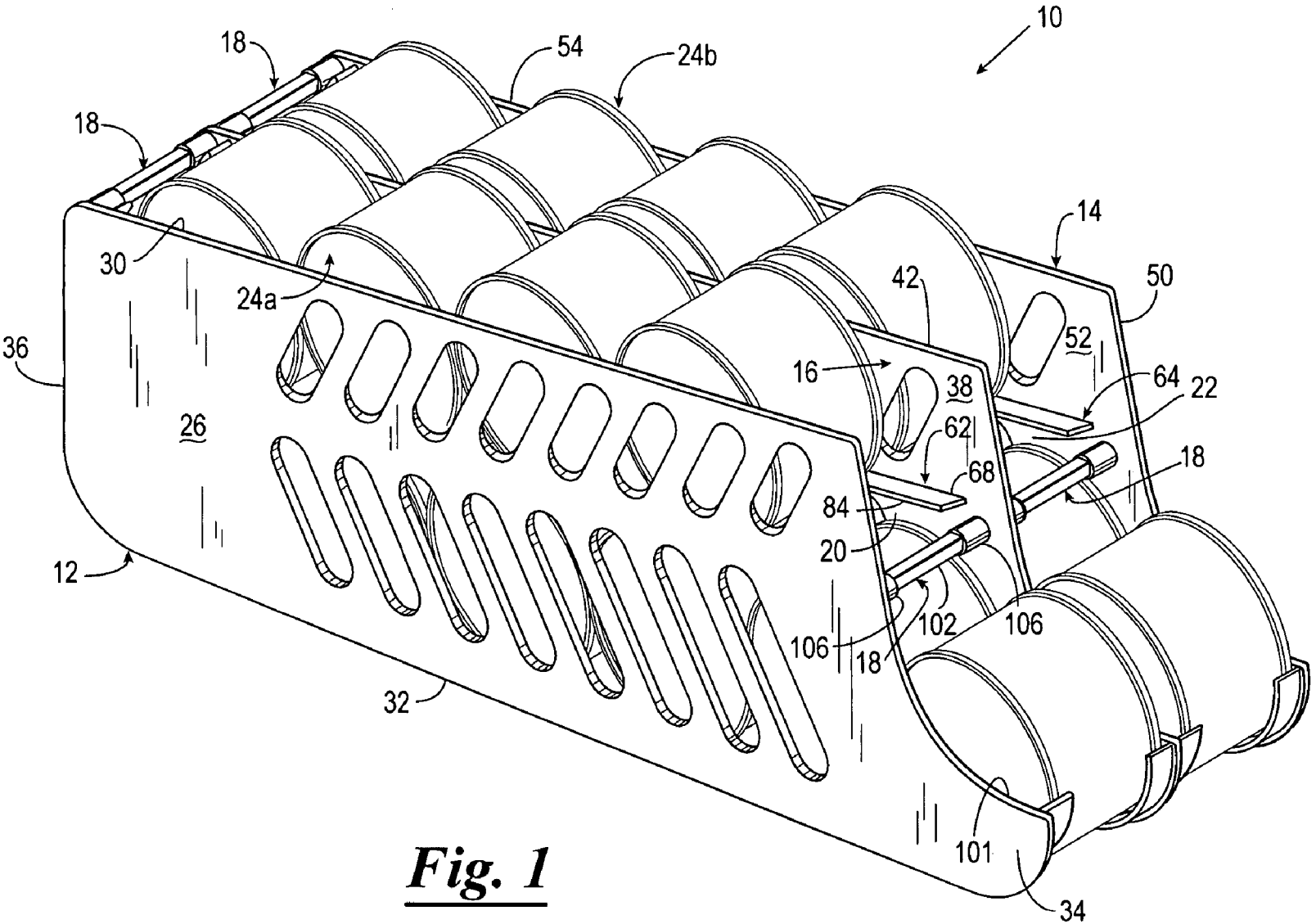
FIG. 1 is a perspective view of a modular storage and dispensing assembly constructed in accordance with the present invention, the modular storage and dispensing assembly being shown with two chutes, each of which contain a plurality of cans.
Figure 2:
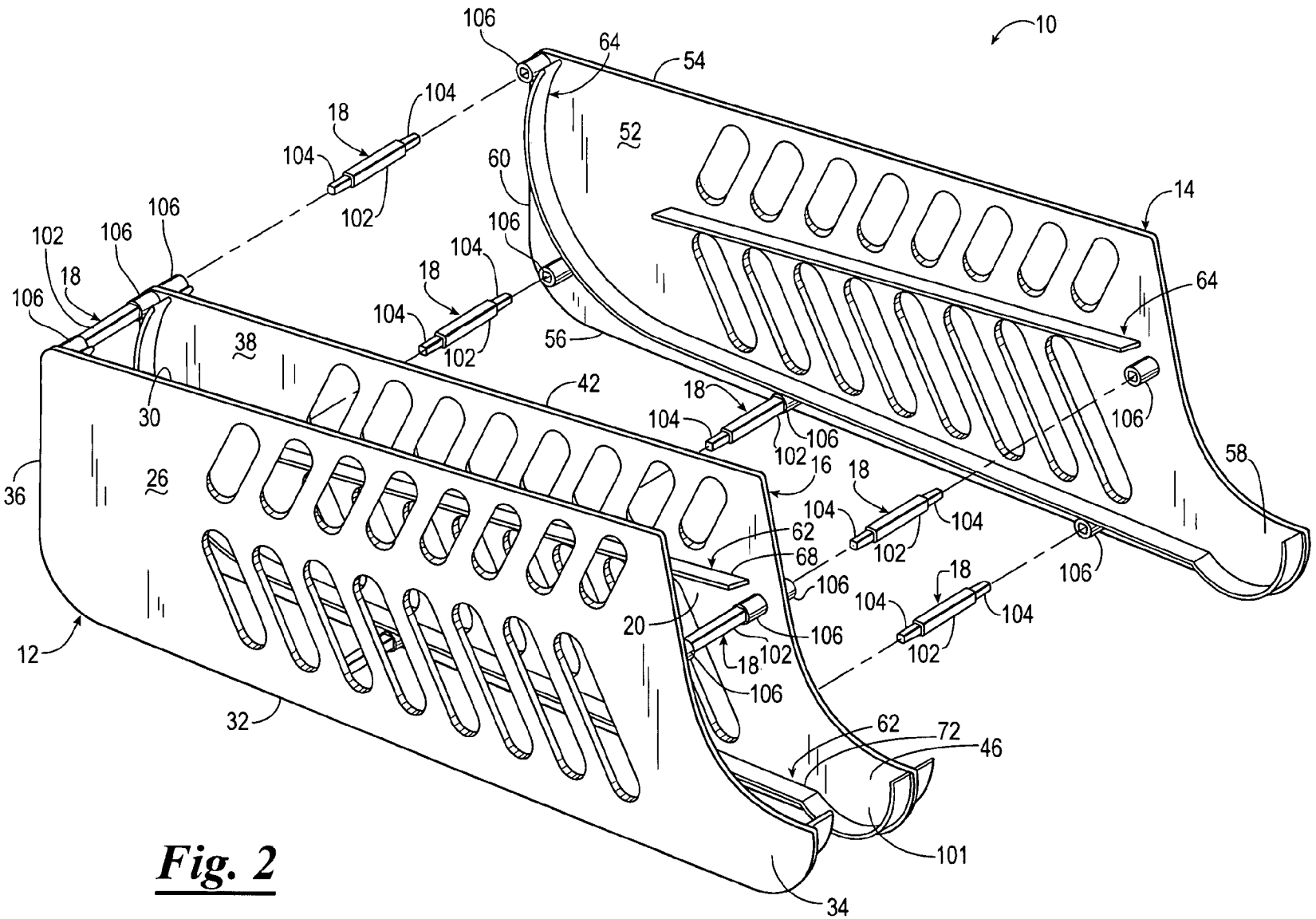
FIG. 2 is a partially exploded perspective view of the modular storage and dispensing assembly of FIG. 1.
Figure 3:
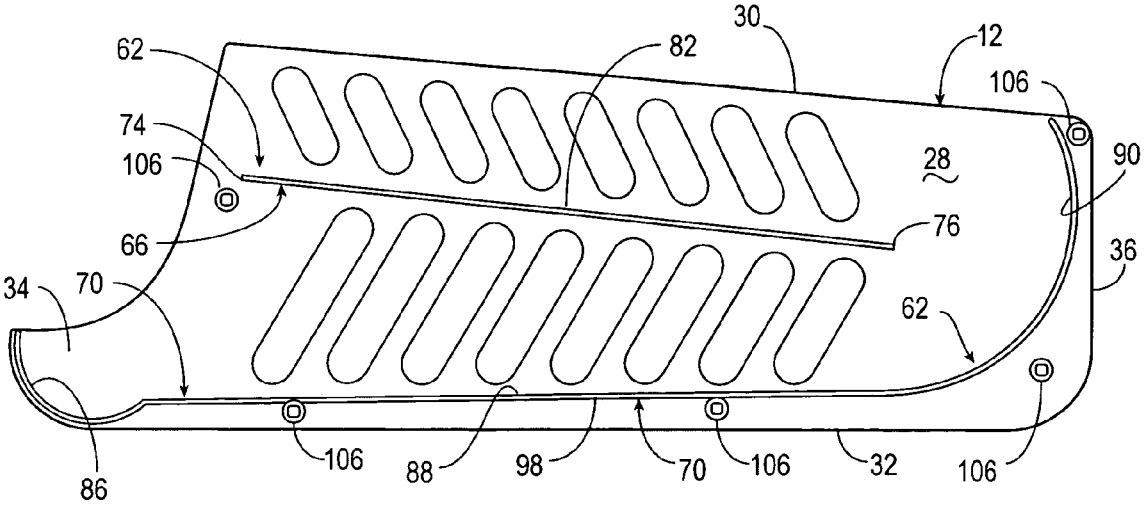
FIG. 3 is an elevational view depicting an inwardly disposed side of a first panel of the modular storage and dispensing assembly of FIGS. 1 and 2.

Referring now to the drawings, and more particularly to FIGS. 1 and 2, shown therein is a modular storage and dispensing assembly 10 constructed in accordance with the present invention. The modular storage and dispensing assembly 10 includes a first panel 12, a second panel 14, a medial panel 16 and a plurality of connector assemblies 18 for connecting the medial panel 16 to the first and second panels 12 and 14, respectively. The connection of the first panel 12 to the medial panel 16 provides the modular storage and dispensing assembly 10 with a first chute 20; and the connection of the second panel 14 to the medial panel 16 provides the modular storage and dispensing assembly 10 with a second chute 22. The first and second chutes 20 and 22 are sized and configured to store a plurality of objects, such as cans 24*a* and 24*b*, which can be selectively dispensed therefrom. It should be understood that the unique design of the modular storage and dispensing assembly 10 enables one to readily increase the number of chutes present in the modular storage and dispensing assembly 10 by the addition and interconnection of additional medial panels 16. For example, if one desires that the modular storage and dispensing assembly 10 have three chutes, a second medial panel (not shown) is interposed between the medial panel 16 and either the first panel 12 or the second panel 14 and the second medial panel is connected to the medial panel 16 and either the first panel 12 or the second panel 14 via the connector assemblies 18 thereby providing the modular storage and dispensing assembly 10 with three chutes. Furthermore, additional chutes can be provided in the modular storage and dispensing assembly 10 by adding additional medial panels 16.

Figure 5:
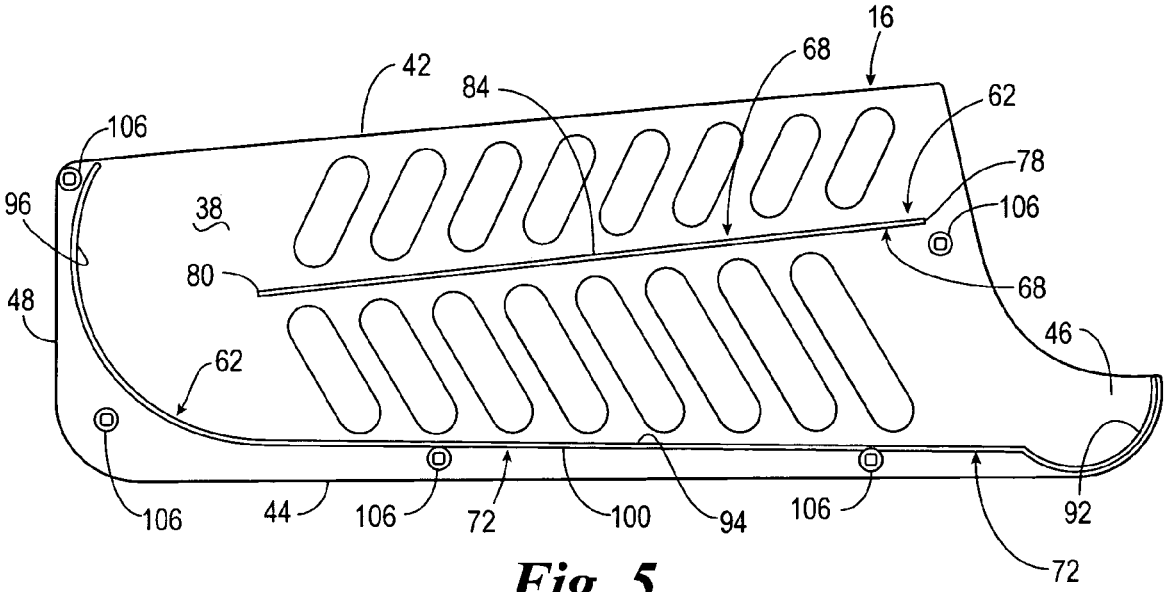
FIG. 5 is an elevational view of one side of a medial panel of the modular storage and dispensing assembly of FIGS. 1 and 2
Figure 6:
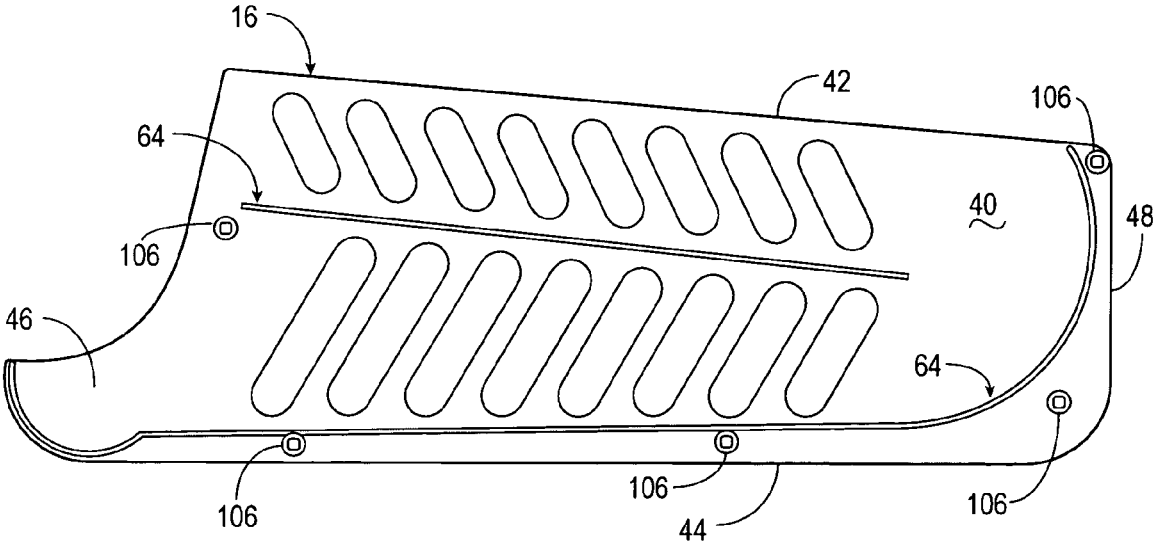
FIG. 6 is an elevational view of an opposed side of the medial panel of the modular storage and dispensing assembly of FIGS. 1 and 2.

Referring more particularly to FIGS. 1–3 and 5, the construction of the first chute 20 of the modular storage and dispensing assembly 10 will be described in more detail. The first panel 12 is provided with a first side 26, a second side 28 (FIG. 3), an upper side 30, a lower side 32, a front lip portion 34 and a rearward end 36. Similarly, the medial panel 16 is provided with a first side 38, a second side 40, an upper side 42, a lower side 44, a front lip portion 46 and a rearward end 48 (FIGS. 5 and 6). The first panel 12 is spatially disposed relative to the medial panel 16, and the first panel 12 is connected to the medial panel 16 via a plurality of the connector assemblies 18 such that the first chute 20 is formed there between.

Figure 4:
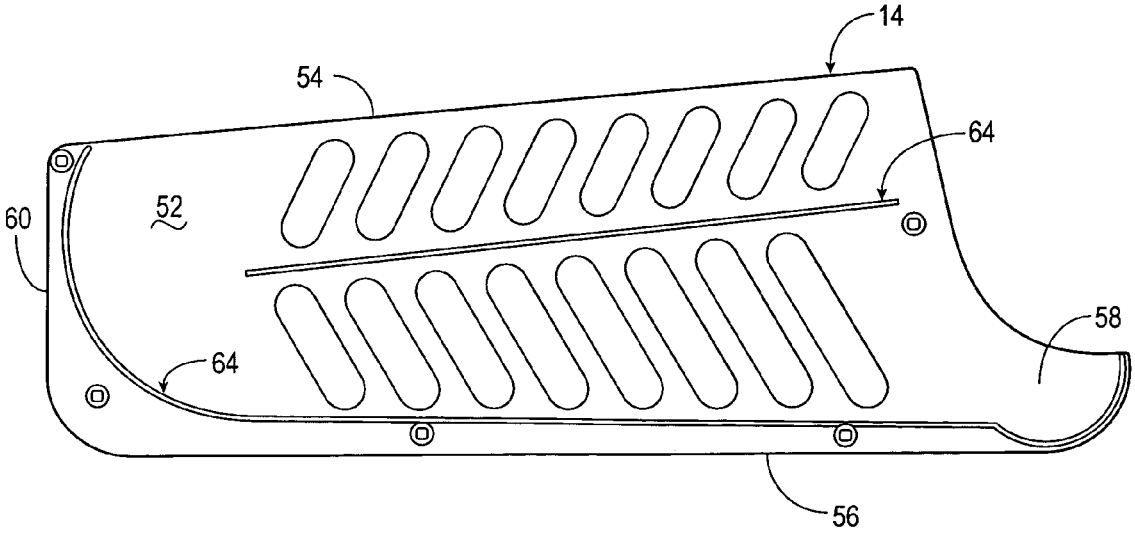
FIG. 4 is an elevational view depicting an inwardly disposed side of a second panel of the modular storage and dispensing assembly of FIGS. 1 and 2.

As shown in FIGS. 1, 2 and 4, the second panel 14, which cooperates with the medial panel 16 to define the second chute 22 of the modular storage and dispensing assembly 10, is provided with a first side 50, a second side 52, an upper side 54, a lower side 56, a front lip portion 58 and a rearward end 60. The second panel 14 is spatially disposed relative to the medial panel 16, and the second panel 14 is connected to the medial panel 16 via a plurality of the connector assemblies 18 such that the second chute 22 is formed there between.

The module storage and dispensing assembly 10 is provided with a first rail assembly 62 and a second rail assembly 64. The first rail assembly 62 is disposed within the first chute 20 and defines a travel path for cans 24*a* traveling through the first chute 20; and the second rail assembly 64 is disposed within the second chute 22 and defines a travel path for cans 24*b* traveling through the second chute 22.

The first rail assembly 62 includes a pair spatially disposed upper rails 66 and 68 and a pair of spatially disposed lower rails 70 and 72. The upper rail 66 is connected to the second side 28 of the first panel 12 such that the upper rail 66 extends inwardly into the first chute 20 (FIG. 3); and the upper rail 68 is connected to the first side 38 of the medial panel 16 such that the upper rail 68 extends inwardly into the first chute 20 (FIG. 5) and is substantially parallel with the upper rail 66. Similarly, the lower rail 70 of the first rail assembly 62 is connected to the second side 28 of the first panel 12 such that the lower rail 70 extends inwardly into the first chute 20 (FIG. 3); and the lower rail 72 is connected to the first side 38 of the medial panel 16 such that the lower rail 72 extends inwardly into the first chute 20 (FIG. 5) and is substantially parallel to the lower rail 70.

The upper rails 66 and 68 are substantially linear and are sloped in a downward direction from their respective first ends 74 and 78 towards their respective second ends 76 and 80 so that cans 24*a* can be moved along the upper rails 66 and 68 and discharged onto the lower rails 70 and 72 as the cans 24*a* travel along the travel path in the first chute 20. The second ends 76 and 80 of the upper rails 66 and 68 terminate a distance from the second or rearward ends 36 and 48 of the first panel 12 and the medial panel 16, respectively, so that the cans 24*a* can make a smooth transition from the upper rails 66 and 68 to the lower rails 70 and 72 of the first rail assembly 62. Further, the upper rails 66 and 68 are angled upwardly toward their outer edges 82 and 84, respectively, to enhance rolling movement of the cans 24*a* there along. The upward angle of the upper rails 66 and 68 toward their outer edges 82 and 84 can vary widely, but will generally be about 1 degree from horizontal.

The lower rail 70 of the first rail assembly 62 is provided with a first end portion 86, a medial portion 88 and second end portion 90. Similarly, the lower rail 72 of the first rail assembly 62 is provided with a first end portion 92, a medial portion 94 and a second end portion 96. The lower rail 70 is connected to the second side 28 of the first panel 12 such that the lower rail 70 extends inwardly into the first chute 20; and the lower rail 72 is connected to the first side 38 of the medial panel 16 such that the lower rail 72 extends inwardly into the first chute 20 and is substantially parallel with the lower rail 70.

The first end portion 86 of the lower rail 70 of the first rail assembly 62 is provided with an arcuate configuration, the medial portion 88 of the lower rail 70 is substantially linear and the second end portion 90 is also provided with an arcuate configuration. Similarly, the first end portion 92 of the lower rail 72 of the first rail assembly 62 is provided with an arcuate configuration, the medial portion 94 of the lower rail 72 is substantially linear and the second end portion 96 is also provided with an arcuate configuration. The lower rails 70 and 72 are substantially parallel to one another and the medial portions 88 and 94 of the lower rails 70 and 72, respectively, are sloped in a downward direction from their respective second end portions 90 and 96 towards their respective first end portions 86 and 92 so that cans 24*a* can be moved along the lower rails 70 and 72 as the cans 24*a* travel along the travel path in the first chute 20.

As previously stated, the second end portions 90 and 96 of the lower rails 70 and 72 are arcuately shaped and are disposed a distance from the second ends 76 and 80 of the upper rails 66 and 68, respectively, so that cans 24*a* moving along the travel path of the first chute 20 have a smooth transition from the upper rails 66 and 68 to the lower rails 70 and 72 of the first rail assembly 62. That is, the arcuate shape of the second end portions 90 and 96 of the lower rails 70 and 72 of the first rail assembly 62, and the distance between the second ends 76 and 80 of the upper rails 66 and 68 of the first rail assembly 62 and the second end portions 90 and 96 of the lower rails 70 and 72 of the first rail assembly 62, permit cans 24*a* traveling along the portion of the travel path defined by the upper rails 66 and 68 to be transferred to the portion of the travel path defined by the lower rails 70 and 72.

The lower rails 70 and 72 of the first rail assembly 62 are angled upwardly toward their outer edges 98 and 100, respectively, to enhance rolling movement of the cans 24*a* along the portion of the travel path defined by the lower rails 70 and 72. The upward angle of the lower rails 70 and 72 toward their outer edges 98 and 100 can vary widely, but will generally be about 1 degree from horizontal.

As previously stated, the first end portions 86 and 92 of the lower rails 70 and 72 are provided with an arcuate configuration. The arcuate configuration of the first end portions 86 and 92 of the lower rails 70 and 72 cooperate with the lip portions 34 and 46 of the first panel 12 and of the medial panel 16 to define a stop 101 for objects (FIGS. 1 and 2), such as cans 24*a*, traveling along the travel path of the first chute 20. Further, the lip portions 34 and 46 of the first panel 12 and the medial panel 16, in combination with the arcuate configuration of the first end portions 86 and 92 of the lower rails 70 and 72 enables one to readily remove one can 24*a* at a time from the modular storage and dispensing assembly 10.

Upon removal of the can 24*a* from the modular storage and dispensing assembly 10, the remaining cans 24*a* in the first chute 20 move along the travel path defined by the first rail assembly 62 until another can 24*a* engages or is disposed within the stop 101, at which time movement of the cans 24*a* through the first chute 20 ceases. It should be noted that the stop 101 formed by the lip portions 34 and 46 of the first and medial panels 12 and 16, as well as the first end portions 86 and 92 of the lower rails 70 and 72 can be any configuration or assembly capable of stopping the cans 24*a* near the end of the travel path through the first chute 20. For example, the stop 101 may be one or more elongated members extending between the lip portions 34 and 46 of the first and medial panels 12 and 16, and/or the first end portions 86 and 92 of the lower rails 70 and 72, or the stop 101 can be one or more doors, levers or any other structure capable of functioning as a stop for cans 24*a* traveling along the travel path in the first chute 20. Further, the configuration of the stop 101 defined by the lip portions 34 and 46 of the first and medial panels 14 and 16 and the first end portions 88 and 92 of the lower rails 70 and 72 can be arcuate, as shown, or the configuration of the stop 101 may be rectangular, triangular, hexagonal, octagonal or even fanciful.

As previously stated, the first panel 12 is connected to the medial panel 16 by a plurality of the connector assemblies 18. The connector assemblies 18 are positioned relative to the first panel 12 and the medial panel 16 such that the connector assemblies 18 do not interfere with movement of the cans 24*a* along the travel path defined in the first chute 20 by the first rail assembly 62.

Referring more specifically to FIG. 2, each of the connector assemblies 18 is illustrated as including an elongated spacer member 102 having a male connector 104 formed on each end thereof, and a female connector 106 adapted to matingly engage the male connectors 104 on each end of the elongated spacer member 102. That is, one of the female connectors 106 extends from the second side 28 of the first panel 12 (FIG. 3); and the female connectors 106, which are aligned with the female connectors 106 on the second side 28 of the first panel 12, extends from the first side 38 of the medial panel 16 (FIG. 5). The connection of the male connectors 104 with the female connectors 106 secures the first panel 12 to the medial panel 16. Further, the connection of the male connectors 104 to the female connectors 106 and the length to the elongated spacer member 102 define the width of the first chute 20. In addition, the positioning of the female connectors 106 of the connector assemblies 18 on the second side 28 of the first panel 12 and the first side 38 of the medial panel 16 is such that the elongated spacer members 102 do not interfere with movement of the cans 24*a* along the travel path in the first chute 20 defined by the first rail assembly 62. It should be noted that any suitable male and female connectors may be employed to connect the first panel 12 to the medial panel 16 as long as such connectors are capable of securing and stabilizing spacer members in a stable position relative to the first panel 12 and the medial panel 16.

As previously stated, the second chute 22 is formed by the connection of the second panel 14 to the medial panel 16 via a plurality of the connector assemblies 18, the elongated spacer members 102 having the male connectors 104 formed on each end thereof, and a plurality of the female connectors 106. The second chute 22 is provided with the second rail assembly 64 which is substantially identical in construction and function as the first rail assembly 62 herein described. Thus, no further discussions concerning the second chute 22, the second rail assembly 64 or the connection of the medial panel 16 to the second panel 14 will be provided. However, it should be understood that the width of the second chute 22 can vary from the width of the first chute 20, if desired, so that cans 24*b* can be of a different size than cans 24*a*. In such event, the only modification to the second chute 22 is to provide elongated spacer members 102 of the connector assemblies 18 with a length different than the length of the elongated spacer members 102 of the connector assemblies 18 employed to connect the first panel 12 to the medial panel 16.

As previously stated, the modular storage and dispensing assembly 10 has been shown and described as having one medial panel 16 positioned between the first panel 12 and second panel 14. However, it should be understood that any number of medial panels 16 can be disposed between the first panel 12 and second panel 14 to increase the storage capacity of the modular storage and dispensing assembly 10. It should also be understood that one could assemble the modular storage and dispensing assembly 10 utilizing only a plurality of the medial panels 16 and the connector assemblies 18, thereby eliminating the need for the first and second panels 12 and 14. In addition, if desired, a single unit of the modular storage and dispensing assembly 10 can be provided wherein the modular storage and dispensing assembly 10 includes only the first panel 12, the second panel 14 and a plurality of the connector assemblies 18.

The first panel 12, the second panel 14, the medial panel 16 and the connector assemblies 18 can be fabricated of any type of material having sufficient structural integrity to permit a plurality of cans 24*a* and 24*b* to be stored in the modular storage dispensing assembly 10, while permitting cans 24*a* and 24*b* to travel through the first and second chutes 20 and 22 provided in the modular storage and dispensing assembly 10. For example, the modular storage dispensing assembly 10, and each component thereof, can be fabricated of plastic materials, metal, wood and the like, the only requirement being that the modular storage and dispensing assembly 10 have sufficient structural integrity to support the weight of the cans or objects supported therein.

From the above description, it is clear that the present invention is well adapted to carry out the objective and attain the advantages mentioned herein as well as those inherent in the invention. While presently preferred embodiments of the invention have been described for purposes of the disclosure, it will be understood that numerous changes may be made which will readily suggest themselves to those skilled in the art and which are accomplished within the spirit of the invention disclosed.

What is claimed is:

1. A modular storage and dispensing assembly comprising:

a plurality of panels;

a connector assembly for connecting adjacently disposed panels such that a chute is provided between each of the adjacently disposed panels;

a rail assembly disposed in each chute for defining a travel path, the rail assembly comprising:

an upper rail supported by adjacently disposed panels and a lower rail supported by adjacently disposed panels, the upper rails being spatially disposed and in a facing relationship, the lower rails being spatially disposed and in a facing relationship, the upper rails each having a first end and second end and the upper rails are sloped in a downward direction from their first ends to their second ends, the lower rails each having an arcuate shaped second end, the lower rails and their arcuate shaped second ends disposed a distance from the upper rails so that objects moving along the travel path of the chute are provided with a smooth transition from the upper rails to the lower rails, the lower rails are further characterized as having a first end portion and the lower rails extend in a downward direction toward the first end portions and wherein the first end portion of the lower rails is provided with an arcuate configuration which extends a distance outwardly from the first end of the upper rails and downwardly from the lower rails for restraining an object therein while permitting the object to be removed therefrom wherein the remaining objects supported by the rail assembly move along the travel path of the chute until the object adjacent the object removed reaches the arcuate shaped first end portions of the lower rails whereby movement of an object disposed in the area defined by the arcuate shaped first end portions of the lower rails of the rail assembly is maintained in a stable position in the arcuate shaped first end portions of the lower rails of the lower rail assembly whereby the object is prevented from moving in a forwardly or rearwardly direction.

2. The modular storage and dispensing assembly of claim 1 wherein the upper rails and the lower rails of the rail assembly are angled upwardly toward their respective outer edges so as to enhance rolling movement of the objects there along.

3. The modular storage and dispensing assembly of claim 2 wherein the upward angle of each of the upper and lower rails is about 1 degree from horizontal.

4. A modular storage and dispensing assembly comprising:

a first side panel, a second side panel and at least one medial panel;

a connector assembly for connecting the first side panel to the medial panel and the medial panel to the second side panel such that a first chute is provided between the first side panel and the medial panel and a second chute is provided between the medial panel and the second side panel;

a rail assembly disposed in each of the first and second chutes for defining a travel path therethrough, each of the rail assembly comprising:

a pair of upper rails and a pair of lower rails, the upper rails being spatially disposed and in a facing relationship and the lower rails being spatially disposed and in a facing relationship, the upper rails each having a first end and second end and the upper rails are sloped in a downward direction from their first ends to their second ends, the lower rails each having an arcuate shaped second end, the lower rails and their arcuate shaped second ends disposed a distance from the upper rails so that objects moving along the travel path of the chutes are provided with a smooth transition from the upper rails to the lower rails the lower rails are further characterized as having a first end portion and the lower rails extend in a downward direction toward the first end portions and wherein the first end portion of the lower rails is provided with an arcuate configuration which extends a distance outwardly from the first end of the upper rails and downwardly from the lower rails for restraining an object therein while permitting the object to be removed therefrom wherein the remaining objects supported by the rail assembly move along the travel path of the chute until the object adjacent the object removed reaches the arcuate shaped first end portions of the lower rails whereby movement of an object disposed in the area defined by the arcuate shaped first end portions of the lower rails of the rail assembly is maintained in a stable position in the arcuate shaped first end portions of the lower rails of the lower rail assembly whereby the object is prevented from moving in a forwardly or rearwardly direction.

5. The modular storage and dispensing assembly of claim 4 wherein the upper rails and the lower rails of each of the rail assemblies are angled upwardly toward their respective outer edges so as to enhance rolling movement of the objects there along.

6. The modular storage and dispensing assembly of claim 5 wherein the upward angle of the upper and lower rails of the rail assembly is about 1 degree from horizontal.

* * * * *